US006332552B1

(12) United States Patent
Iwasaki et al.

(10) Patent No.: US 6,332,552 B1
(45) Date of Patent: Dec. 25, 2001

(54) CONTAINER CLOSURE

(75) Inventors: Yoshio Iwasaki; Akira Morita, both of Shiga-ken; Hirotsugu Mori, Kyoto, all of (JP)

(73) Assignee: Ishida Co., Ltd., Kyoto-Fu (JP)

( * ) Notice: Subject to any disclaimer, the term of this patent is extended or adjusted under 35 U.S.C. 154(b) by 0 days.

(21) Appl. No.: 09/503,155

(22) Filed: Feb. 11, 2000

(30) Foreign Application Priority Data

Feb. 16, 1999 (JP) ..... 11-036885
Jul. 5, 1999 (JP) ..... 11-189923

(51) Int. Cl.[7] ..... B65D 17/40
(52) U.S. Cl. ..... 220/276; 220/269; 220/270
(58) Field of Search ..... 220/269, 270, 220/276

(56) References Cited

U.S. PATENT DOCUMENTS

| | | | | |
|---|---|---|---|---|
| 4,212,409 | | 7/1980 | Jeppsson . | |
| 4,408,697 | | 10/1983 | Yoshikawa et al. . | |
| 4,448,324 | | 5/1984 | Jeppsson et al. . | |
| 4,501,372 | * | 2/1985 | Hansen | 215/247 |
| 4,533,063 | | 8/1985 | Buchner et al. . | |
| 4,616,766 | * | 10/1986 | Miyauchi et al. | 220/450 |
| 4,762,245 | * | 8/1988 | Matsubayashi et al. | 220/269 |
| 4,890,759 | | 1/1990 | Scanga et al. . | |
| 5,054,641 | * | 10/1991 | Sato | 220/270 |
| 5,069,372 | * | 12/1991 | Kawajiri et al. | 222/541.9 |
| 5,103,973 | * | 4/1992 | Sato | 220/270 |
| 5,806,757 | * | 9/1998 | Per et al. | 229/204 |
| 6,145,689 | * | 11/2000 | Kobayashi et al. | 220/276 |

FOREIGN PATENT DOCUMENTS

| | | | |
|---|---|---|---|
| 0 283 534 A1 | 9/1988 | (EP) | B65D/17/28 |
| 0 322 238 A1 | 6/1989 | (EP) | B65D/17/28 |
| 59-229329 | 12/1984 | (JP) | B29F/1/10 |

* cited by examiner

*Primary Examiner*—Stephen Castellano
(74) *Attorney, Agent, or Firm*—Sughrue Mion, PLLC

(57) ABSTRACT

There is provided a container closure that can easily be manufactured, has improved drop strength and is convenient for opening operation. The present invention provides a container closure which includes a substrate having adequate property for retaining an object which is enclosed in a container, a peripheral section formed on the periphery area of the container closure on the opposite side of a side where the substrate is attached to a container body, a panel section covering an area of the substrate surrounding by the peripheral section on the same side where the peripheral section is provided, and a score section formed between the peripheral portion and the panel section to provide a weakened region. The peripheral section and the panel section is a plastic layer formed with the same heat-fusible plastic as the substrate. A substantial area of the score section is constructed of the substrate. Further, a thin layer is formed on at least a part of the score section with the heat-fusible plastic that connects the peripheral section and the panel section.

17 Claims, 18 Drawing Sheets

FIG. 11

Number of Available Mold to Number of Gate

| diameter of the closure / number of gate | 307 $\phi$ type | 301 $\phi$ type | 201 $\phi$ type |
|---|---|---|---|
| 1 | 24 | 36 | 49 |
| 2 | 24 | 24 | 24 |

FIG. 12a

Table-2 Can Opening Property

| opening operation | aspect | embodiment | comparative example |
|---|---|---|---|
| pull up the tub | easy to pull up by finger | 1.5 | 1.5 |
| puncture | easy to puncture | 1.2 | 1.2 |
| pull off | require the force | 0.8 | 1.0 |
| tear off | easy to tear off | 0.5 | 0.5 |

FIG. 12b

Table-3 Drop Strength Test

| drop direction / sample / height | tub edge | | 90° from tub edge | |
|---|---|---|---|---|
| | embodiment | comparative example | embodiment | comparative example |
| 80cm | 0/10 | 0/10 | 0/10 | 0/10 |
| 90 | 0/10 | 0/10 | 0/10 | 0/10 |
| 100 | 2/10 | 2/10 | 0/10 | 0/10 |
| 110 | 1/8 | 2/8 | 0/10 | 2/10 |
| 120 | 2/7 | 2/6 | 0/10 | 3/8 |
| 130 | 3/5 | 2/4 | 0/10 | 1/5 |

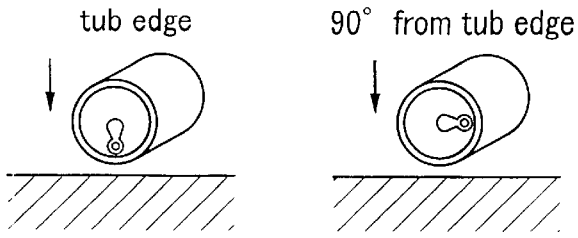

CONTAINER CLOSURE

FIELD OF THE INVENTION

The present invention relates to a container closure comprising a peripheral section adapted to be attached to a peripheral edge of an opening of a container body, a panel section surrounding by the peripheral section, and a score section formed on the periphery of the panel section for providing a weakened region and to a method for manufacturing such a container closure.

PRIOR ART

It is common to store beverage and food in a container like a can and close the container tightly with a sealing closure for preservation or sales display at a shop front. A closure for this type of container is structured to have a score line for breaking the closure so that the container is opened by pulling a pulling tab provided to the closure to thereby break the closure along the score line.

Conventional container closure provided with this type of pulling tab may include those which are totally or substantially formed of a metallic material and those which are formed of a plastic material by injection molding. The closure using plastic material generally has a gas barrier layer whose major component is aluminum foil which is covered by layers of a plastic material formed by injection-molding on either or both sides of the gas barrier layer. At the peripheral section a rim is formed to be attached to a peripheral edge portion of the opening of the container body.

The Japanese Patent Publication No. 64-10170 describes a container closure having a peripheral section attached to a peripheral edge of an opening of a container body and a panel section covering an area surrounded by the peripheral section, on the opposite side of a surface of a multi-layer substrate, where heat-fusible plastic layers are formed on two or one side of a gas barrier material, the surface coupling with the opening of the container body, and a manufacturing method thereof. In the manufacturing method for the container closure, described in the above publication, one or more gate is used respectively for forming the peripheral section and the panel section. Since a score section of the container closure described in the publication is composed only of the multi-layer substrate, it may be easy for the closure to be broken but has problem of low drop-resistant strength. For forming the closure, one or more gates are necessary respectively for the peripheral section and the panel section. That is, two or more gates have to be provided for forming one closure.

In such a mold subjected to two or more gates, it is necessary to provide two or more manifolds and to provide an excessive area for arranging the manifolds to prevent interference of each manifold when the mold for a closure having 80 mm or less in nominal inner diameter (307 Φ or less in nominal diameter). Thus, when the mold was installed in a restricted space, the available number of molds attached would be constrained so that a problem of lower productivity would be caused.

DISCLOSURE OF THE INVENTION

It is therefore an object of the present invention to provide a container closure that is easy to manufacture and has excellent drop-resistant strength.

Another object of the present invention is to provide a method for manufacturing such container a closure.

The present invention provides a container closure comprising, a substrate having adequate property for retaining an object which is enclosed in a container, a peripheral section formed on the periphery area of the container closure on the opposite side of a side where the substrate is attached to a container body, a panel section covering an area of the substrate surrounding by the peripheral section on the same side where the peripheral section is provided, and a score section formed between the peripheral portion and the panel section to provide a weakened region, the peripheral section and the panel section is a plastic layer formed with the same heat-fusible plastic on the substrate, substantial area of the score section constructed of the substrate, characterized in that the thin layer formed on at least a part of the substrate of the score section with the heat-fusible plastic which connects the peripheral section and the panel section.

In one embodiment of the present invention, a pulling tab is attached to the panel section to separate the panel section from the peripheral section along the score line by pulling the pulling tab off. On the plastic material layer of the panel section, a projection extending laterally with respect to the pulling tab at a position adjacent to the front end portion of the pulling tab can be integrally formed with plastic material. The pulling tab may further include a puncture portion for causing the panel section to be broken along the score section when the pulling tab is pulled off to the panel section.

A thin layer is provided on circumference or a part of the score section. For forming the tab, the panel section and the peripheral section by an injection-molding machine having one gate, it needs to have a connecting portion where the panel section and the peripheral section are connected with each other. The thin layer is provided from this point of view and may be formed on entire circumference, half round, or several areas with desired width of the score section. Several areas of the thin layer may also be formed in bridge-shape.

Thickness of the thin layer is generally desirable to be as less as possible for easy opening of the container, but excessive reduction of the thickness disturbs the flow of plastic through the connecting portion. Though flowability of plastic and formability can be improved by increasing the thickness, excessive increase disturbs to the easy opening. Thickness of the thin layer is generally desirable to be set in 80–150 $\mu$m in consideration of the easy opening. For maintaining the easy opening, thickness of the thin layer is desirable to be decreased. Considering better flowability of plastic through the thin layer in molding process, plastic having high flowability, preferably having M.R.F (Melt Flow Rate) of 30 or more is desirable to be used.

The present invention further provides a method for forming the above container closure by molding plastic material. In this method, a metal mold is first prepared, the mold comprising, a peripheral recess for forming the peripheral section, a center recess for forming the panel section, a connection recess for forming the thin layer which connects at least an area between both the recesses, and an injection gate for injecting plastic to ether of the peripheral recess and the center recess. The present method provides steps, the steps comprising, positioning the substrate along a molding surface of the mold, closing the mold, injecting molten heat-fusible plastic on the substrate through the injection gate so that the plastic may flow from one of the peripheral recess and center recess to another of the recesses through the connection recess to form the thin layer between the peripheral section and the panel section of the container closure.

In a method for forming the container closure according to one embodiment of the present invention, all of the panel section, the pulling tab and the peripheral section can be formed only by one gate disposed in either of the center recess for forming the panel section and a recess for forming the pulling tab disposed in the center recess. Thus, one resultant closure can be obtained only one manifold so that interference of each manifold in case of two or more gates can be avoided. Accordingly, since the manifold doesn't occupy its space more than necessary so that adequate number of molds can be attached to achieve lower plant investment and higher productivity.

BRIEF DESCRIPTION OF THE DRAWINGS

FIG. 11 is a chart showing the relationship between number of gate and available number of mold attached;

FIG. 12*a* is a chart showing an evaluation result for readiness of opening the container according to the present invention and the container closure as the comparative example;

FIG. 12*b* is a chart showing a test result for drop-resistant strength of a container closure of the present invention and the container closure as the comparative example;

DESCRIPTION OF THE PREFERRED EMBODIMENT

Figure 1:
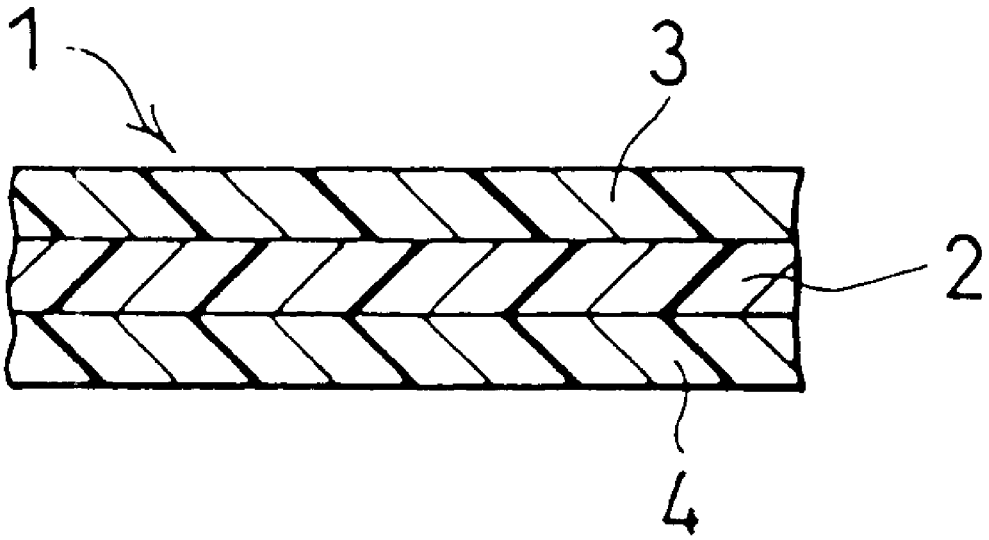
FIG. 1 is a cross-sectional view showing one example of a substrate for use of a container closure according to the present invention.

The present invention will hereafter be described taking reference to the accompanying drawings, which show an embodiment thereof. Referring now to FIG. 1, there is shown an example of a gas blocking substrate 1 which may be used for forming a panel section in accordance with an embodiment of the present invention. The gas blocking substrate 1 comprises a thin sheet 2 which may be a metal foil such as aluminum foil, iron foil, and the like, or a sheet of other material of gas blocking property such as saponified ethylene vinyl acetate copolymer, poly-vinylidene chloride, poly-amide, poly-acrylo nitride, or the like. Layers 3,4 of heat-fusible plastic material are formed on the opposite surface of the sheet 2. Material of the gas blocking substrate may be selected from oxygen, water vapor, or material having the flavour blocking property as required. The layer 3 is provided to cover the upper face of the sheet 2 and made of a material capable of forming an intimate layer together with a plastic layer which will be formed in later stage by injection molding over the gas barrier substrate 1. Materials that can be used for this purpose include polypropylene, polyethylene, polyester, polyamide, polycarbonate, polystyrene, and the like. In case of a container for retort pouch food, polypropylene is preferable. The plastic material layer 4 is provided on the lower face on the sheet 2 and is adapted for heat-sealing the closure to the peripheral edge portion of the top opening of a container body. Preferable material for this purpose include polypropylene, polyethylene, polyester, polyamide, polycarbonate, polyacrylo nitrile, polystyrene, or any other adhesive materials such as maleic anhydride graft polymerized carboxyl group denatured polypropylene, carboxyl group denatured linear low density polyethylene.

Figure 2A:
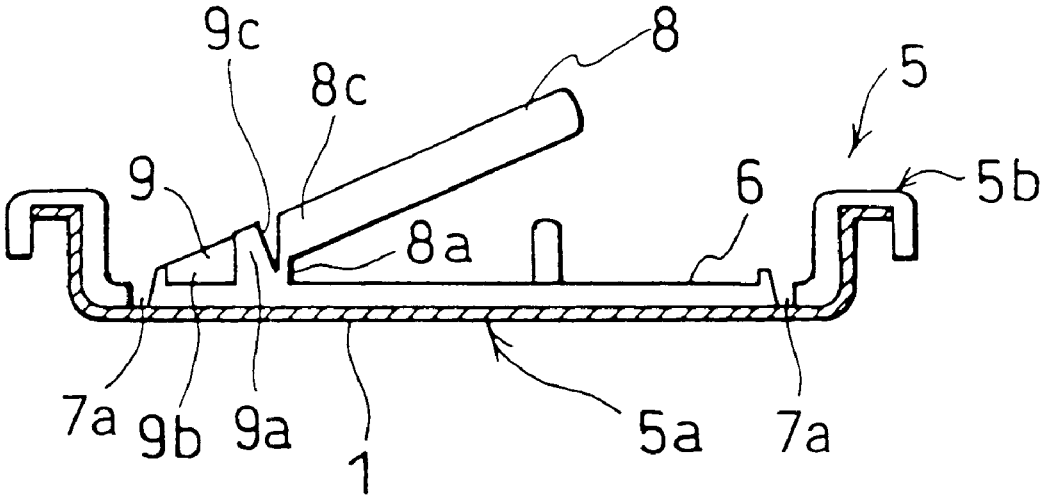
FIG. 2*a* is a cross-sectional view showing one embodiment of a container closure according to the present invention taken along line a—a.
Figure 2B:
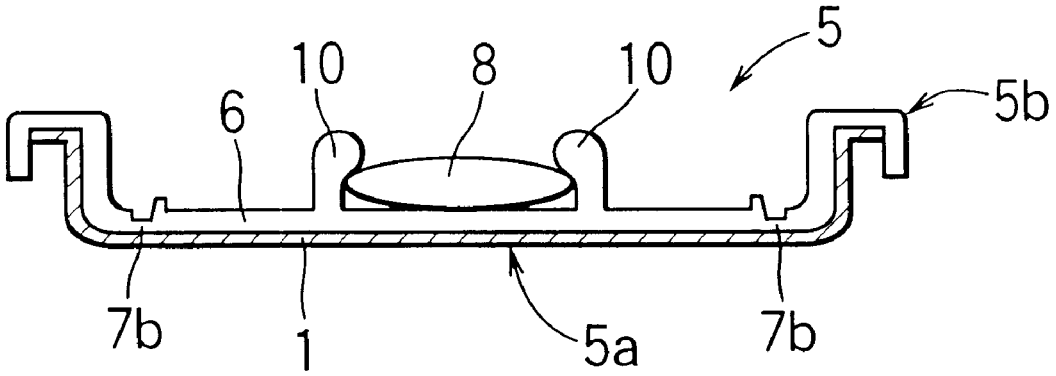
FIG. 2*b* is a cross-sectional view showing one embodiment of a container closure according to the present invention taken along line b—b of FIG. 2*a;*
Figure 3:
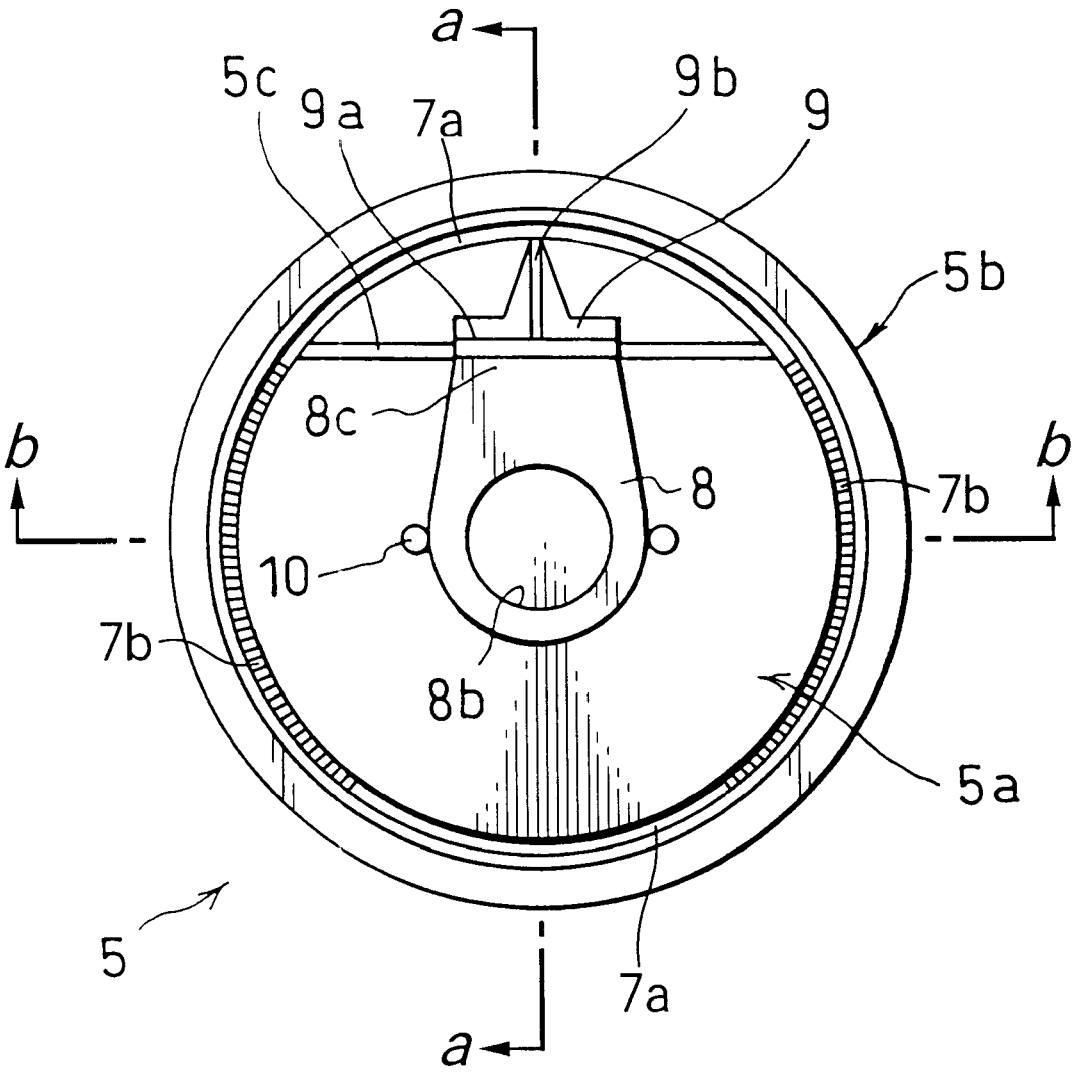
FIG. 3 is a top view of the container closure shown in FIG. 2*a* and FIG. 2*b;*
Figure 4A:
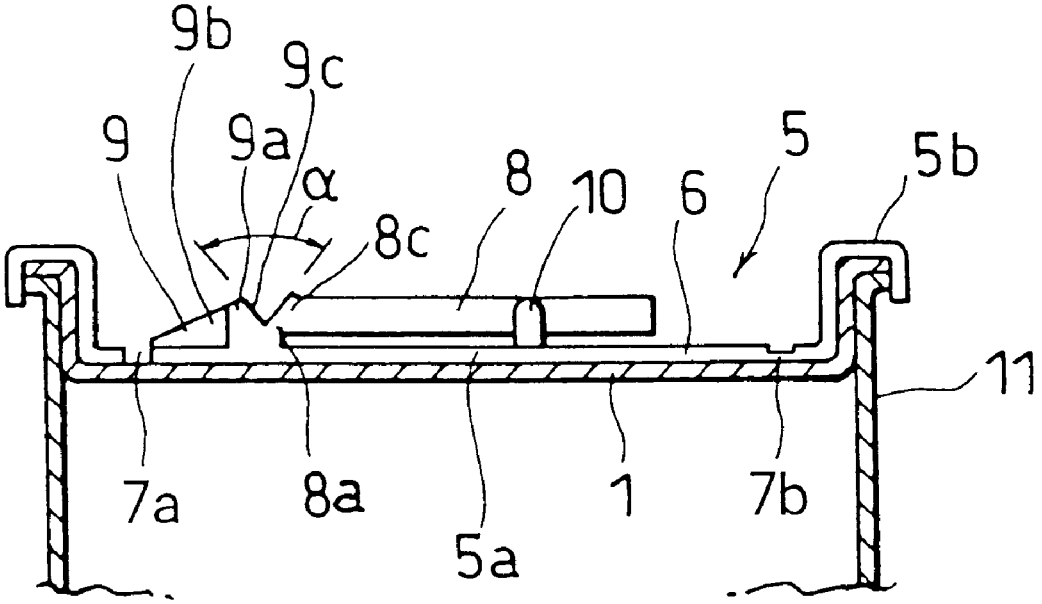
FIG. 4*a* is a longitudinal cross-sectional view illustrating the container closure in using cognition shown in FIG. 2*a* and FIG. 2*b;*

FIGS. 2*a*, 2*b* and 3 show a container closure 5 embodying the present invention. The closure 5 comprises a gas blocking substrate 1 shown in FIG. 1 and a layer 6 of a plastic material formed on the upper face of the substrate 1. The container closure 5 comprises a planer panel section 5*a* which is shaped to conform to a top opening of a container body (not illustrated) such as a can and an annular peripheral section including a raised ridge portion formed along a periphery of the panel section 5*a*. The peripheral section of the gas blocking substrate 1 is bent to form a substantially Z-shaped cross-section as shown in FIG. 2*a* and FIG. 4*a*. The peripheral section of the plastic material layer 6 has a portion which is laid over the peripheral portion of the gas blocking substrate 1 and the outer fringe of the plastic material layer 6 is further bent downward to form a downwardly opening annular groove.

A score lines 7*a*, 7*b* of a score section are formed substantially along the inner circumference of the peripheral section 5*b* of the container closure 5. In the present embodiment, the score line 7*a* is formed by marking the plastic material layer 6 to be discontinuous to thereby expose the gas blocking substrate 1. The score line 7*b* is formed of the gas blocking substrate 1 and a thin layer provided on the gas blocking substrate 1 to connect the panel section and the peripheral section of the closure. As shown in FIG. 3, the score line 7*b* is formed on both sides of the score section and extends from respective positions where the score section crosses with a groove 5*c* to cover substantially quarter of the entire score section. In the panel section 5*a* surrounded by the score line 7*a*, 7*b*, the groove 5*c* is formed in the plastic material layer 6 of the panel section 5*a* at a position corresponding to the front end of the pulling tab to extend in the direction of a chord. This groove 5*c* is formed by providing a thin walled portion in the plastic material layer 6 of the panel section 5*a*.

Figure 13:
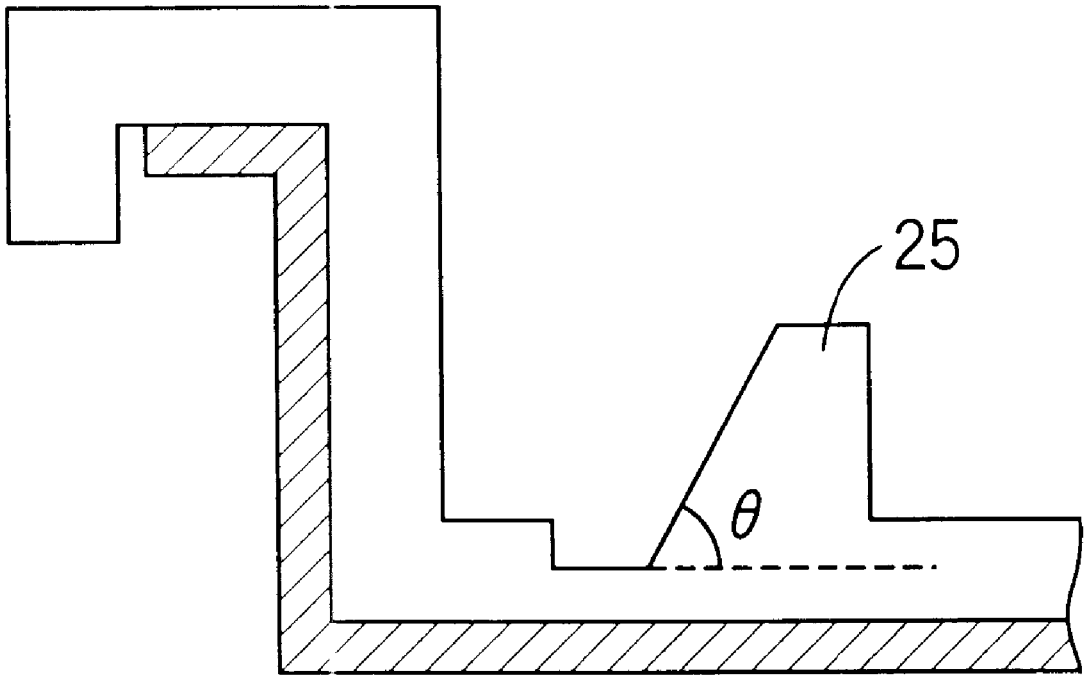
FIG. 13 is cross-sectional view showing an example of a bank portion provided on a container closure.
Figure 18A:
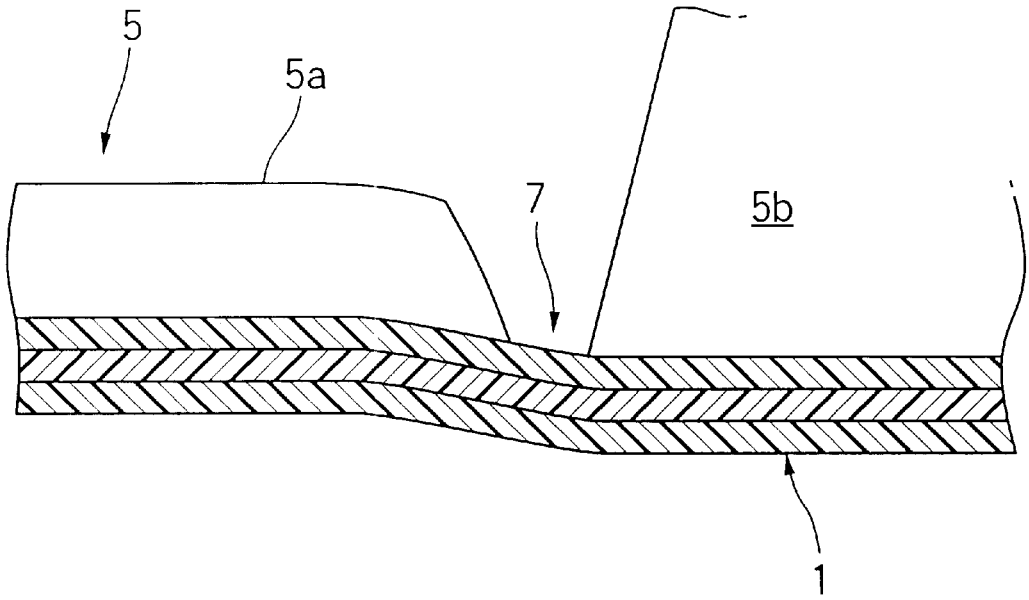
FIG. 18*a* is showing an effect of a bank-like raised portion formed on the periphery area of a panel section in the case that the raised portion is eliminated.
Figure 18B:
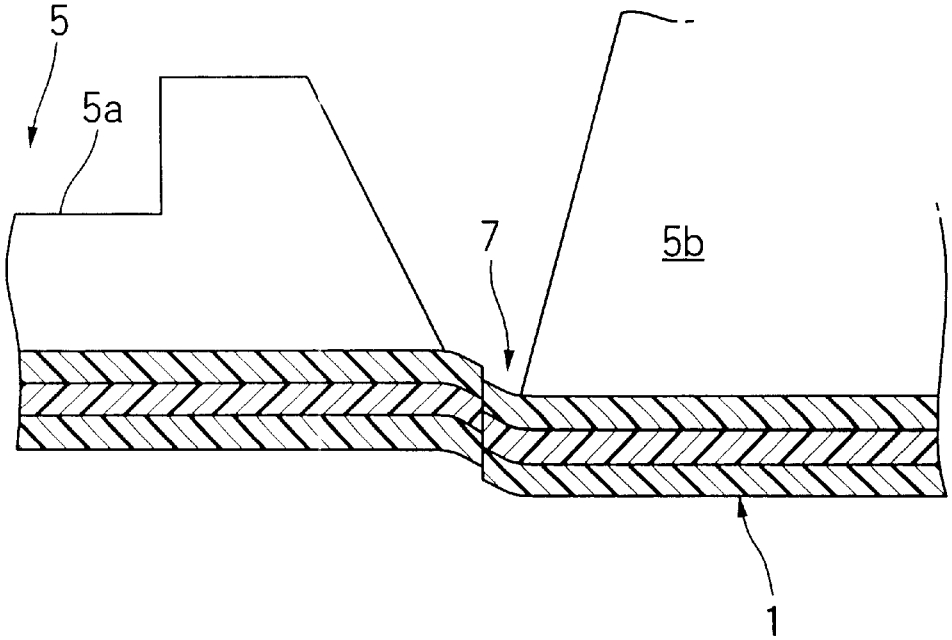
FIG. 18*b* is showing an effect of a bank-like raised portion formed on the periphery area of a panel section in the case that the raised portion is provided.

As shown in FIG. 13, a bank-like end portion 25 is preferably formed in the manner that the plastic material layer 6 of the panel section 5*a* is upheaved at a periphery portion of the panel section bordering on the score section. An inclination θ of the end portion to horizontal plane is preferably about 30–90° and more preferably in 80–90°. The inclination of bank-like end portion 25 may be changed in stages such that the inclination in the height direction in the range of about 0.1 mm–0.3 mm from a portion bordering on the score section is set in 80–90° and the inclination in a succeeding portion is set in about 60°. Height of the end portion is preferably 0.1–1.0 mm and more preferably about 0.5. An effect of such an end portion is to improve readiness of opening the container due to the fact that deformation of the panel section is restrained when the closure is broken. FIGS. 18*a* and 18*b* show the effect. In the case which is devoid of a bank-like end potion 25, when a force is acted between the panel section 5*a* and the peripheral section 5*b* to break the closure, the area around an edge area of the panel section 5*a* is deformed as shown in FIG. 18*a*. Thus, the force for breaking the closure is not as effective, so that it is more difficult to break the closure. In contrast, when a bank-like end portion 25 is provided in the panel section 5*a* as described above, stiffness of an edge area of the panel section 5*a* is increased so that the force for breaking the closure is effectively acted to the score section as shown in FIG. 18*b*. With the bank-like end portion, thermal contraction of a panel section caused just after molding can also be prevented forcibly by a mold so that a break of a score section may be avoided. With the above inclination in addition to the bank-like end portion, a molded closure can be released from a mold and it can also be avoided to suffer a wound by an opening edge when the closure is broken.

As shown in FIGS. 2*a* and 2*b*, the pulling tab 8 is connected through a thin walled hinge portion 8*a* to the plastic material layer 6 on the panel section 5*a*. As shown in FIG. 3, the pulling tab 8 is a substantially planar configuration having an aperture 8*b* accommodating a finger for opening the closure. The thickness of the tab 8 is substantially uniform throughout the length as shown in FIGS. 2*a* and 2*b*. In a preferred embodiment, the thickness of the pulling tab 8 is about 2.0 mm to 5.0 mm and that of the hinge portion is about 30 μm to 600 μm.

A projection 9 is formed and located adjacent to the front end portion 8*c* of the pulling tab 8. This projection 9 comprises a ridge 9*a* which is located outside the groove 5*c* at a position close to the score line. The ridge 9*a* extends along the score line 5*c*. There is also formed a reinforcement 9*b* for transmitting pushing force from the tab 8 to the panel section 5*a*. The reinforcement 9*b* is formed integrally with the ridge 9*a* so as to extend outwards from the central portion of the ridge 9*a* toward the score line 7. The ridge 9*a* of the projection 9 has a slant face 9*c* which is adapted to be brought into contact with the front end of the pulling tab 8 (hereafter referred to as a slant contacting face 9*c*) when the pulling tab 8 is pulled off from the panel 5*a*.

Figure 4B:
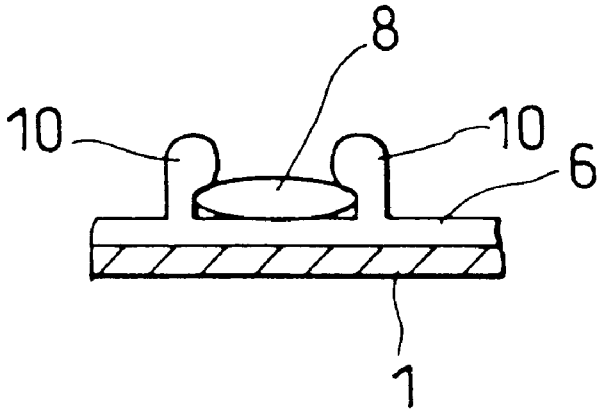
FIG. 4*b* is a cross-sectional view showing a tab.

As shown in FIG. 4*b*, a pair of holding portions 10 is formed on the upper face of the plastic material layer 6 of the panel section 5*a* of the container closure 5. These holding portions 10 resiliently hold the pulling tab 8 at both sides thereof and thereby function so that the pulling tab 8 is held substantially in parallel with the panel section 5*a* as shown in FIGS. 4*a*, 4*b*. As shown in FIG. 4*a*, in the position where the pulling tab 8 is held substantially parallel with the panel section 5*a*, a V-notch having an including angle α is formed between the front end 8*c* of the pulling tab 8 and the slant contacting face 9*c* of the ridge 9*a* of the projection 9. The container closure 5 shown in FIG. 4 is heat sealed to the peripheral edge portion of the upper opening of the container body 11.

Figure 5:
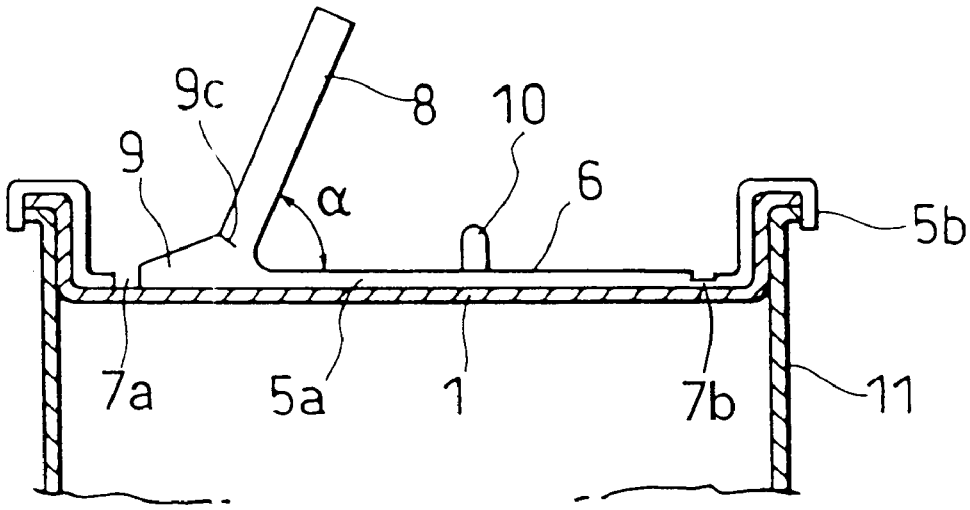
FIG. 5 is a cross-sectional view showing a condition right after opening operation of a container closure is initiated.
Figure 6:
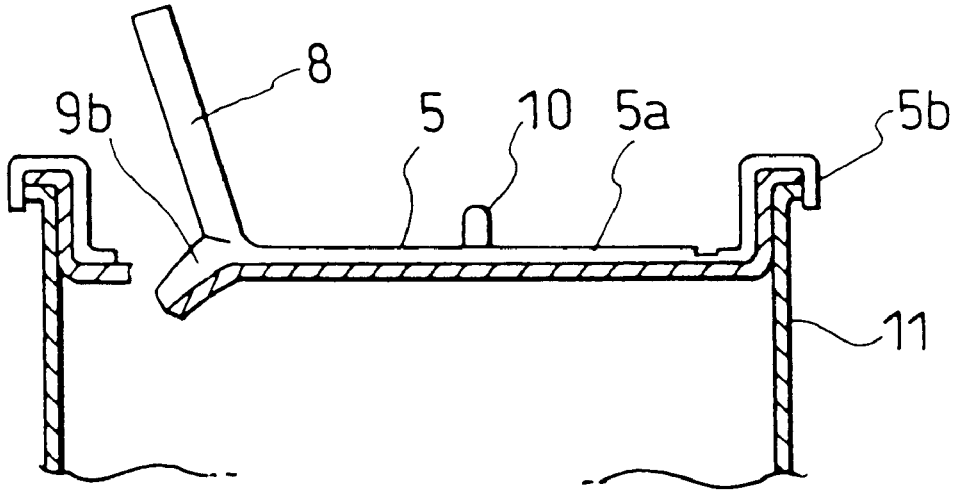
FIG. 6 is a cross-sectional view showing a condition right after a container closure is opened.
Figure 16A:
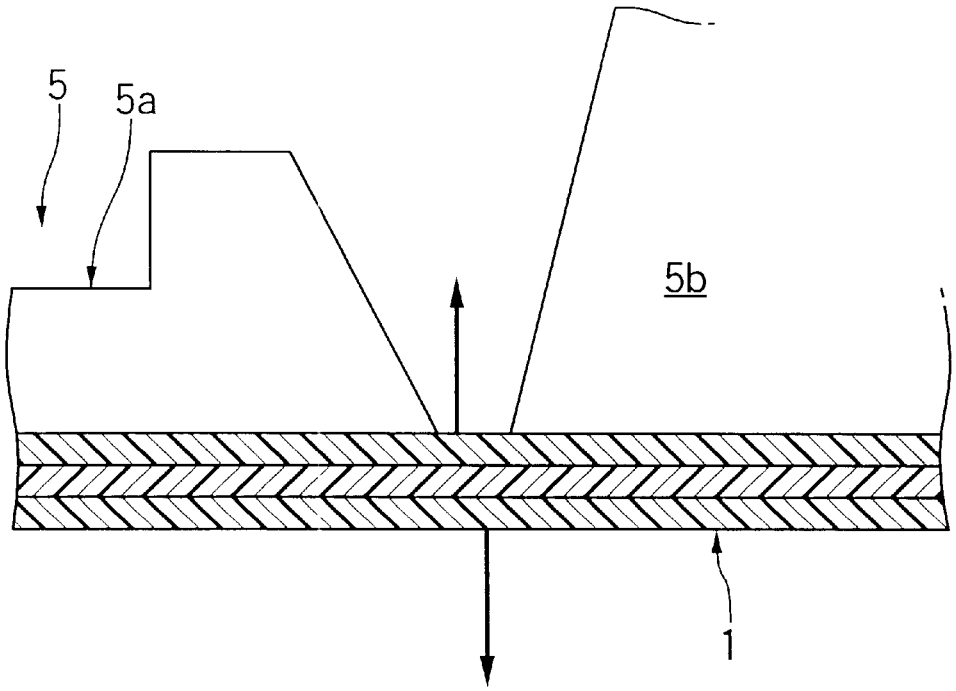
FIG. 16*a* shows forces acting between a panel section and a peripheral section of a container closure when both sides of the sections are broken at intermediate stage of the opening operation of the container closure.
Figure 16B:
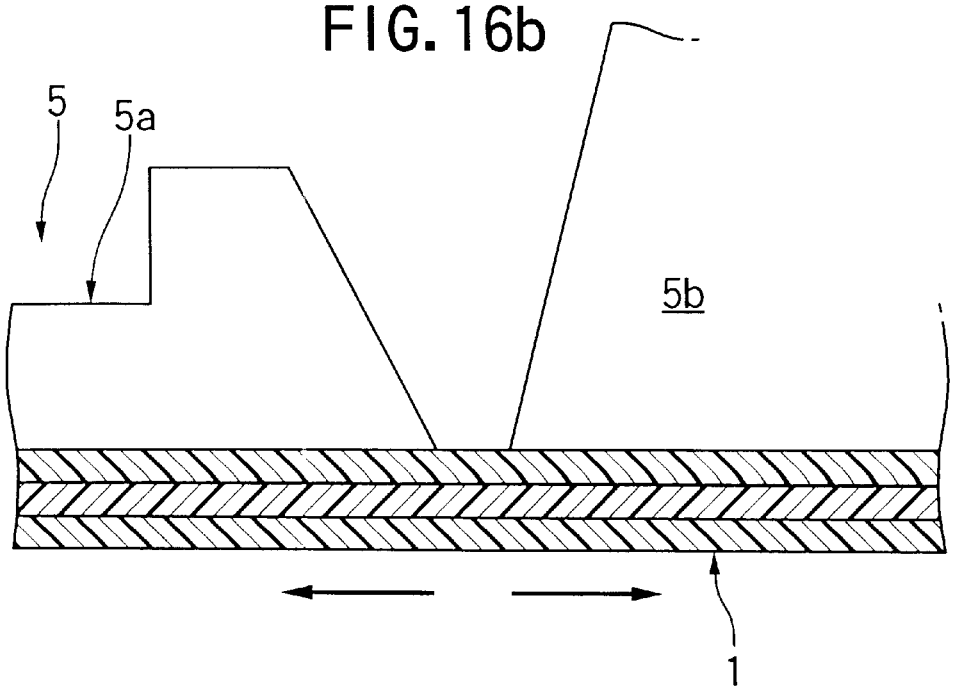
FIG. 16*b* shows force directions acting between a panel section and a peripheral section of a container closure at start stage and completion stage of the opening operation of the container closure.
Figure 17:
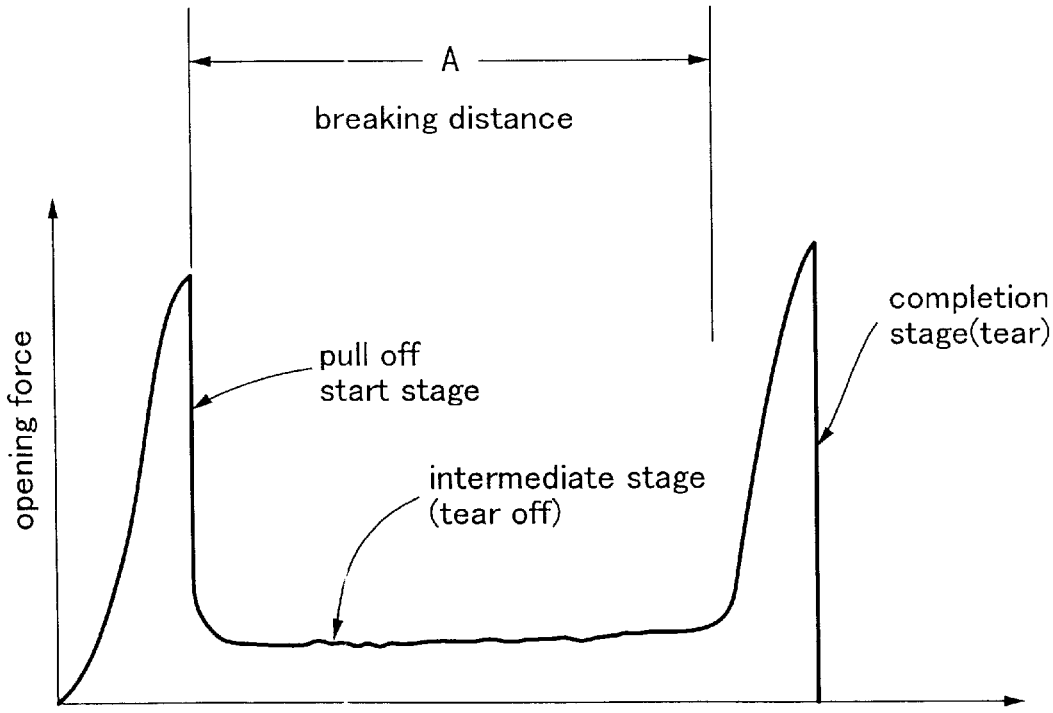
FIG. 17 is a diagram showing transition of the force needed for the opening operation of the container closure.

When it is desired to open the closure, the pulling tab 8 is pulled off from the face of the panel section 6 to the position shown in FIG. 5, so that the front end 8*c* of the pulling tab 8 is brought into contact with the slant contacting face 9*c* formed on the ridge 9*a* of the projection 9. When the pulling tab 8 is pulled off to the angle α, the front end 8*c* of the pulling tab 8 contacts with the slant contacting face 9*c* formed at the ridge 9*a* of the projection 9. In this position, when the pulling tab is further pulled upwards, the reinforcement 9*b* of the projection 9 penetrates into the gas blocking substrate 1 of the panel section 5*a* so that the panel section 5*a* is broken along the score line 7 as shown in FIG. 6. Then the pulling tab 8 is further pulled off, to cause the panel section 5*a* of the closure 5 to be separated along the score line 7 from the peripheral section 5*b*. As show in FIG. 16*a* showing forces acting in the above operation, an edge area of the panel section 5*a* is pulled upwards to the panel section 5*a*. This force acts to the gas blocking substrate 1 force as shearing force so that the gas blocking substrate can easily be broken and the panel section 5*a* can be pulled off with relatively small force. In contrast, relatively strong force is required at the start stage of opening operation just after the panel section 5*a* begins to be broken due to the penetration of the reinforcement 9*b* into the gas blocking substrate caused by the pressing force from the front end 8*c* of the pulling tub 8 and at the completion stage of opening operation just before the panel section 5*a* is torn off. FIG. 17 shows transition of the force needed for the opening operation from the start stage to the completion stage through the intermediate stage when the pulling tub 8 is pulled upwards. Though force required for the opening operation is generally increased by providing the thin layer to the score section, load to the customer in the opening operation can be reduced when the thin layer is formed on the region A where a relatively small force is required for the opening operation shown in FIG. 17. In this view, the position of the score sections shown in FIG. 3 is suitable. However, in the present invention, a thin layer may be provided on most of the score section except the puncture portion where the reinforcement 9*b* of the projection penetrates the panel section. That is, a thin layer may be provided on the region of the score section positioned at both sides to a centerline that connects each center of the puncture portion and the panel section and also at opposite side to the puncture portion in radial direction.

In the present invention, the angle $\alpha$ is preferably determined to be between 30 and 90 degrees but a larger angle up to 120 degrees, for example, may be adopted.

As described above, the score line 7*a* is formed by making the plastic material 6 to be discontinuous to thereby expose the gas blocking substrate, while the score line 7*b* is formed on gas blocking substrate 1 by depositing the thin layer connected with both of the panel section and the peripheral section.

In order for providing the properties of readiness of opening the container through the aforementioned processes, as well as the drop-resistant strength of the tightly-closed container, break-resistant strength in molding, etc., the thickness of the sheet 2 of the gas blocking substrate 1 is preferably determined to be less than 50 $\mu$m and preferably about between 9 $\mu$m and 30 $\mu$m. The thickness of each of the plastic material layers 3, 4 is preferably less than 100 $\mu$m.

The thickness of the thin layer of the score line 7*b* is preferably about between 50 $\mu$m and 300 $\mu$m and more preferably between 80 $\mu$m and 150 $\mu$m. The total thickness of the gas block substrate and the deposited thin layer is between 150 $\mu$m and 400 $\mu$m and preferably between 150 $\mu$m and 300 $\mu$m. The width of the score line 7*a*, 7*b* should not be so large and is preferably less than 1.0 mm and more preferably less than 0.3 mm.

Figure 7:
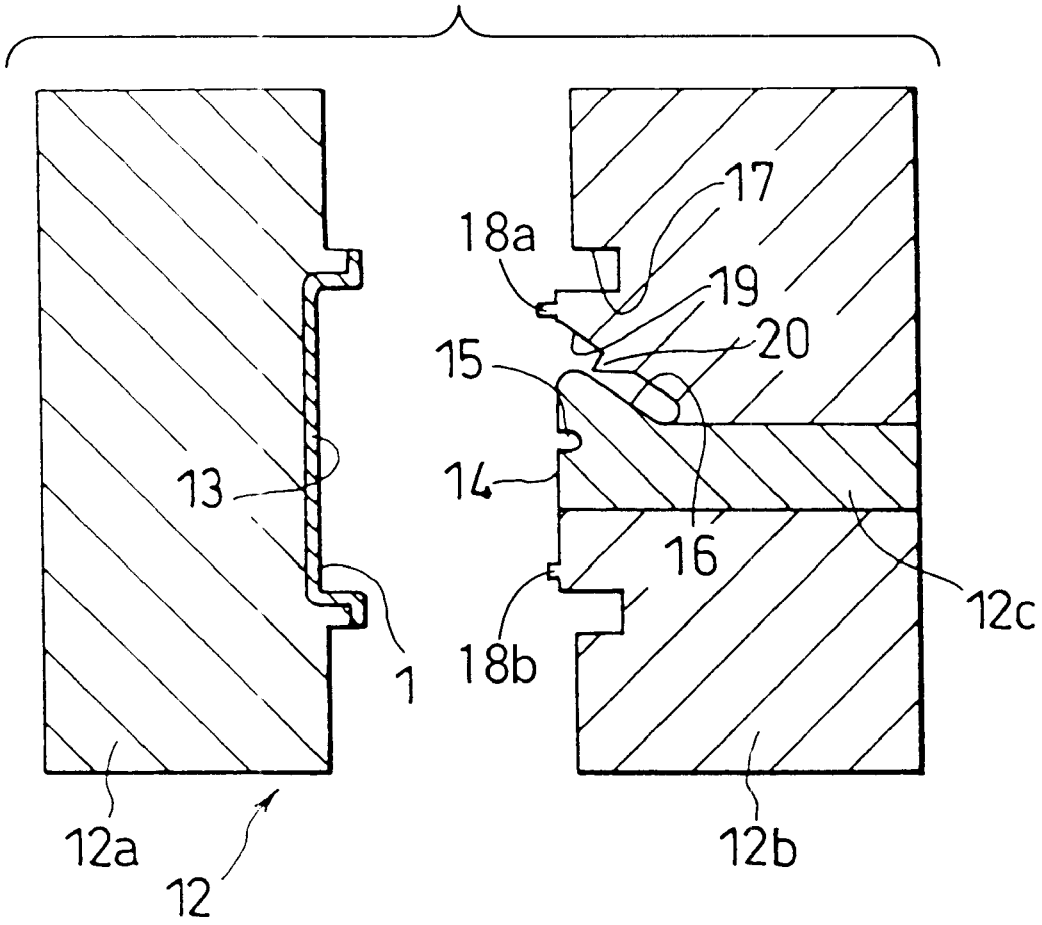
FIG. 7 is a cross-sectional view showing a mold in an opening condition for forming a container closure according to the present invention.

FIG. 7 shows an injection mold assembly 12 employed for molding a container closure 5 of an embodiment of the present invention. The mold 12 comprises a lower mold 12*a*, an upper mold 12*b*, and a slide core 12*c*. The lower mold 12*a* has a recessed mold portion 13 for disposing the gas blocking substrate 1 of the container closure 5. The slide core 12*c* is arranged so as to slide up and down in the upper mold 12*b*. The slide core 12*c* is provided at its lower end with a flat plane 14 for forming the upper face of the plastic material layer 6 and a recess 15 for forming the holding portions 10. The slide core 12*c* is provided with an upwardly facing molding face 16 that is slanted with respect to the flat plane 14 by a predetermined angle for forming the pulling tab 8. The inclination angle of the molding face 16 with respect to the flat face 14 is smaller than the angle a described above. The upper mold 12*b* comprises a molding recess 17 for molding the peripheral section 5*b* and an annular projection 18*a*, 18*b* for forming the score line 7*a*, 7*b*. The height of the annular projection 18*a* is determined to make the front edge of the annular projection 18*b* contact to the gas block substrate 1 when molds are closed so that the score line 7*a* may be formed by marking the plastic material layer 6 to be discontinuous to thereby expose the gas blocking substrate 1. The height of the annular projection 18*b* is determined to make a gap corresponding to the thickness of the thin layer between the front edge of the annular projection 18*b* and the gas blocking substrate 1.

Further the upper mold 12*b* comprises a molding face 19 adapted to cooperate with the molding face 16 of the slide core 12*c* for molding the pulling tab and a projection 20 for forming the hinge portion 8*a*.

Figure 8A:
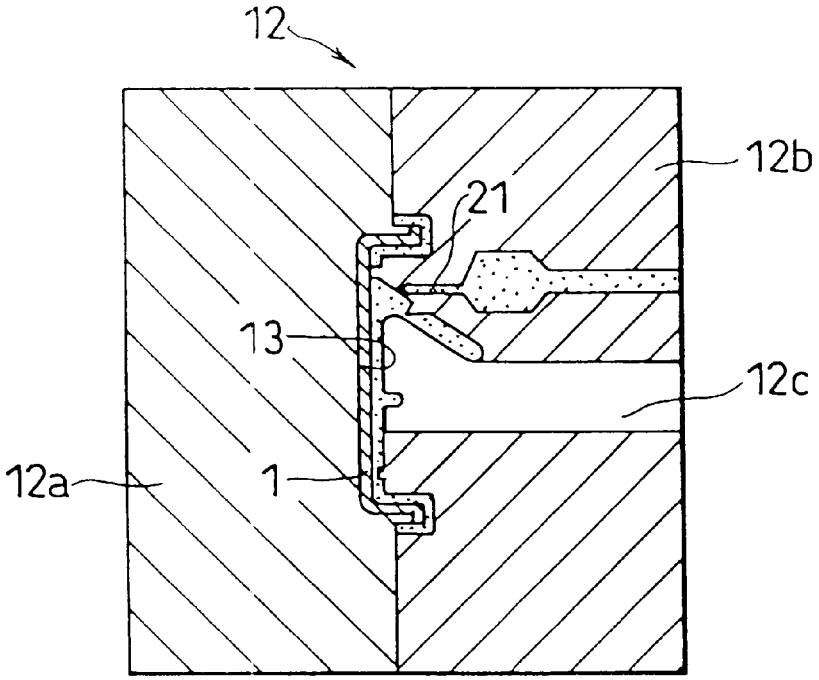
FIG. 8*a* is a cross-sectional view showing a mold in a condition when the mold is closed and molten plastic is being injecting.
Figure 8B:
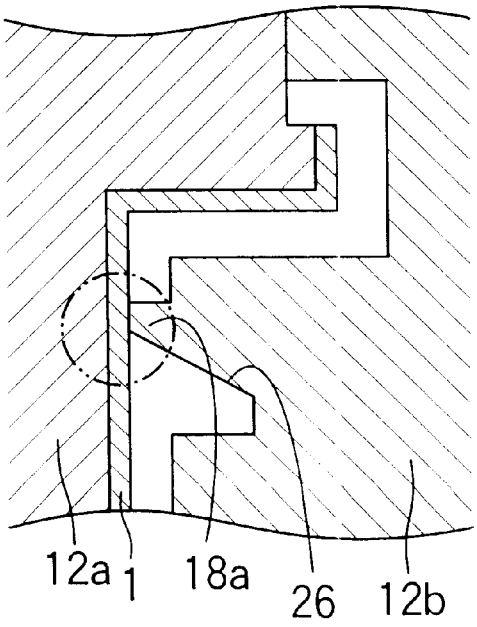
FIG. 8*b* is a cross-sectional view showing a mold having a higher raised portion not to form a thin layer.
Figure 8C:
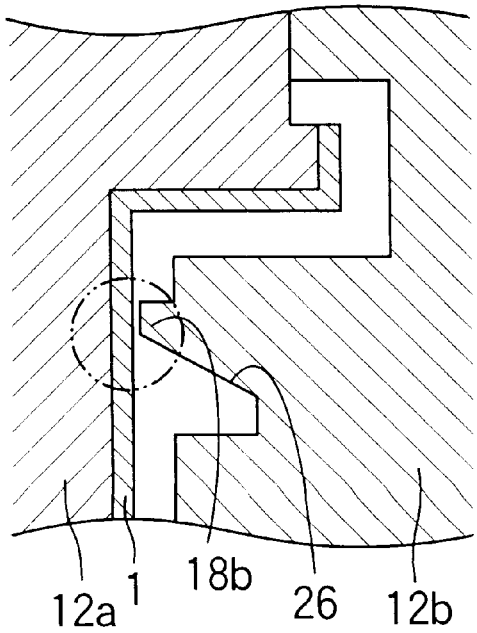
FIG. 8*c* is a cross-sectional view showing a mold having a lower raised portion to form a thin layer alone a score line.

As shown in FIGS. 8*a* through 8*c*, after the upper mold 12*b* has been assembled with the slide core 12*c* inserted into the upper mold 12*b*, the gas blocking substrate 1 is disposed on the mold recess portion 13 of the lower mold 12*a*, and the upper mold 12*b* is then placed on the lower mold 12*a* to form a molding cavity. The upper mold 12*b* includes one injection gate 21 for injecting the molten plastic material into the molding cavity. The gate 21 is open to the cavity at a position corresponding to the projection 9.

In this condition, molten plastic material is injected from the gate 21 into the cavity to completely fill the cavity. The molten plastic material first fills the recesses for forming the pulling tab 8 and the panel section 5*a* and then moves through the gap constructing the recess for forming the thin layer of the score line 7*b* and then fills the recess for forming the peripheral section.

Figure 9A:
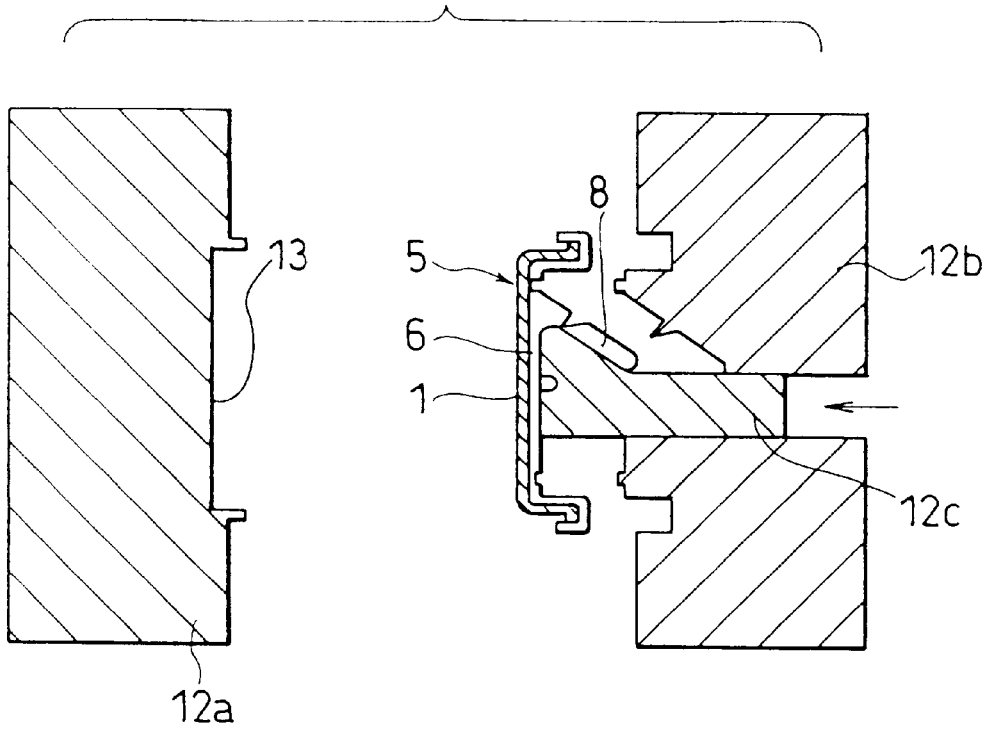
FIG. 9*a* is a cross-sectional view showing a condition when a formed container closure of the present invention is taken out from a mold.
Figure 9B:
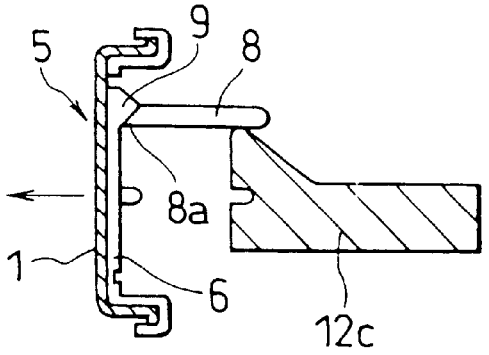
FIG. 9*b* is a cross-sectional view showing a condition when a tub is bended to pull out a slid core.

After the injected plastic material has been solidified, the upper mold 12*b* is separated from the lower mold 12*a* as shown in FIG. 9*a*. In this step, the slide core 12*c* is also separated from the lower mold 12*b*. The molded container closure 5 is taken out from the slide core 12*c* by bending the pulling tab 8 around its hinge portion.

Materials such as polypropylene, polyethylene, polyester, polyamide, polycarbonate, and polystyrene may be used for molding the plastic material layer 6. Inorganic filler may be mixed to these materials. The mixed inorganic filler improves the dimensional stability of the container closure and reduces the thermal contraction rate. Further, the addition of such inorganic material is effective to improve thermal resistance, with the result that the thermal deformation temperature can be increased, and the thermal conductivity can be improved. Such property of the closure is preferable for use with a container for retort pouch food. Further, it should be noted that, in disposing the container closure after use, the thermal calorie produced during the incineration could be decreased. This property is effective to protect the incinerator from thermal damage. The added inorganic filler can give the container closure more rigidity which provides advantages for the distribution of product.

As inorganic filler, those employed as additives in the fields of synthetic plastic material or rubber is available. For example, any substance may be employed so long as it is an inorganic compound inactive to oxygen and water, preferable in terms of food sanitation, and not dissolvable during the process of kneading and molding. For example, materials made of materials such as compounds like metal oxide, hydrate (hydroxide) thereof, sulfate, carbonate, silicate of a metal, and their double salts, or their compounds may be used. Further, materials that may be used for the purpose include aluminum hydrate, calcium hydrate, magnesium hydrate, zinc oxide, red lead, magnesium carbonate, calcium carbonate, white carbon, tale, mica, glass fiber, glass powder, glass beads, diatomaceous earth, silica, wollastonite, iron oxide, titanium oxide, lithophne, punice powder, gypsum, barium carbonate, dolomite, and iron sand. Among these filler materials, those in powder form preferably have a diameter less than 20 $\mu$m, more preferably less than 10 $\mu$m. Those in fiber form preferably are from 1 to 500 $\mu$m in diameter, more preferably from 1 to 300 $\mu$m, and are from 0.1 to 6 mm in length, more preferably from 0.1 to 5 mm. Those in planar form are preferably less than 30 $\mu$m in diameter, more preferably from 1 to 10 $\mu$m. Among these inorganic fillers, those having planar or powder form are especially preferable. Besides those described above, various additives including pigment may be added to the plastic material for use in the injection molding. A container closure may be jointed to a container body by use of the high frequency sealing process, ultrasonic sealing process, or the like.

EXAMPLE 1

1. The injection machine having the cramp capacity of 350 ton, the mount size of 1035 mm×1035 mm, and the tie bar distance of 730 mm×730 mm were used and the one gate type mold and the two gates type mold were installed therein. The evaluation result of available number of mold attached in each type of mold is shown in chart 1. The valve gate is used as gale for this evaluation. The total diameter of the manifold and its attachment used was 40ϕ.

As shown in Table 1, in case of the closure of 307ϕ type (diameter of the peripheral edge portion was 92 mm), available number was 24 for both of the one gate and two gates type. However, in case of the closure of 301ϕ type (diameter of the peripheral edge portion was 78 mm), available number was 36 for one gate type, while that was 24 at best for two gates type.

Thus, with the one gate type, the number of molds attached can be selected corresponding to the project area of closure diameter in case of 301ϕ or less so that the number of attached in the tie bar distance may be increased to improve productivity. In addition, using one valve gate type can reduce equipment expenses.

2. A gas blocking barrier multi-layered substrate 1 was prepared by an aluminum foil 2 of 30 μm thick which is attached at one side with an ethylene propylene block copolymer (M.F.R.=1.1, ethylene content 9 wt %) film of 30 μm in thickness which functions as a heat-fusible layer to be bonded to a container body, through a maleic anhydride graft polymerized polypropylene plastic material (M.F.R.=20) layer of 3 μm in thickness placed therebetween. The layers were firmly fixed together by passing through a thermal roll to apply heat. On the other side of the aluminum foil 2 of the gas blocking barrier multi-layered substrate 1, there was formed a layer of ethylene propylene block copolymer (M.F.R.=1.1, ethylene content 9 wt %) film of 30 μm in thickness which is attached to the aluminum foil by a polyurethane based adhesive (4.5 g/m$^2$). The layer functions as a heat fusible layer adapted to be integrated with an injection plastic material. Thus, multi-layer substrate 1 applied for a container closure as an embodiment according to the present invention was prepared.

The multi-layered substrate 1 was disposed in the recessed mold portion 13 of the lower mold 12*a* of the mold 12 shown in FIGS. 8*a* through 8*b*, and an ethylene propylene block copolymer (Nippon Polyolefin Co. Ltd., PM970W, MF.K.=30) was injected through the gates 21 to form container closure 5 shown in FIGS. 2*a*, 2*b* and 3.

In the above process, a thin layer was formed by reducing the height of the portion (reference numeral 18*b* in FIG. 8*c*) of the projection 18 corresponding to the score line form a thin film of 120 μm. The thin layer was weldingly deposited and fixed on the multi-layer substrate 1 of 100 μm to form the score line 7*b* having the total thickness of 220 μm.

Concurrently, a bank-like end portion 25 is formed in the periphery portion of the panel section with the recess 26 provided closely inside of the annular projection 18*a*.

For obtaining a comparative sample, a score line 7*a*, 7*b* where the multi-layer substrate 1 was exposed in entire circumference of the score section is formed by equalizing the height of the annular projections 18*a* and 18*b* shown in FIG. 7 to make them contact with the multi-layer substrate 1 in order to make the plastic material layer 6 discontinuous.

Figure 10A:
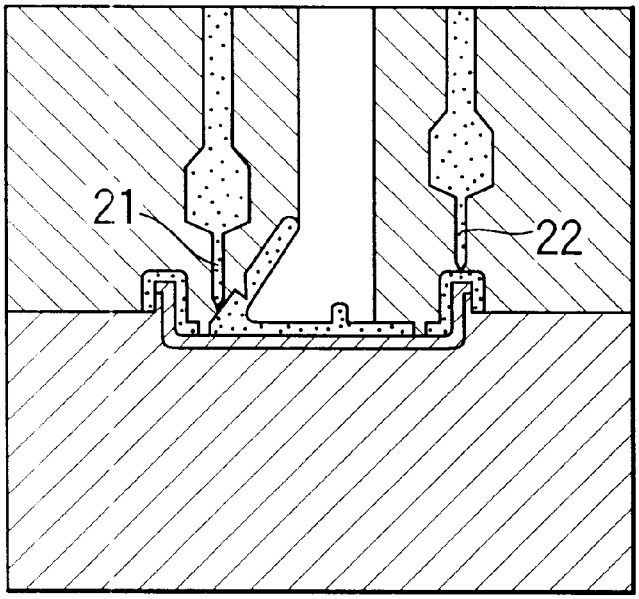
FIG. 10*a* is a cross-sectional view showing a mold for manufacturing a container closure as a comparative example.
Figure 10B:
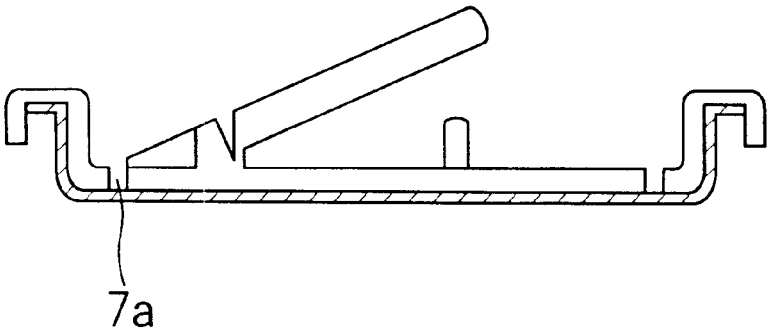
FIG. 10*b* a cross-sectional view showing the container closure manufactured by the mold shown in FIG. 10*a;*

As shown in FIG. 10*a*, a container closure as the comparative sample shown in FIG. 10*b* is formed with the same of multi-layer substrate, injection molding machine and injection material and also under the same injection condition of the above example except that two gates (21,22) were provided.

A polypropylene container was fully filled with water of 230 g and the container closure was heat sealed by high frequency sealing process and a retort sterilization at 125° C. for 30 minutes was then implemented to make the test sample. Using the embodiment of the present invention and the comparative sample, pulling tab operation feeling was evaluated by 10 panelists and a tensile tester and the drop strength was also evaluated in the actual drop test.

The force needed to open the container was measured by the STOROGRAPH V1-C type tensile tester produced by Toyo Seiki Seisakusho. After the container closure 5 as testing sample was attached to the container body 11 and then the pulling tab 8 was pulled off to the position shown in FIG. 6, the container body 11 was set and fixed in the jig 32 of the tester in the manner that the pulling tab 8 faced downwardly to enable the hook 33 of the tester to engaged with and pull off the pulling tab.

Figure 19A:
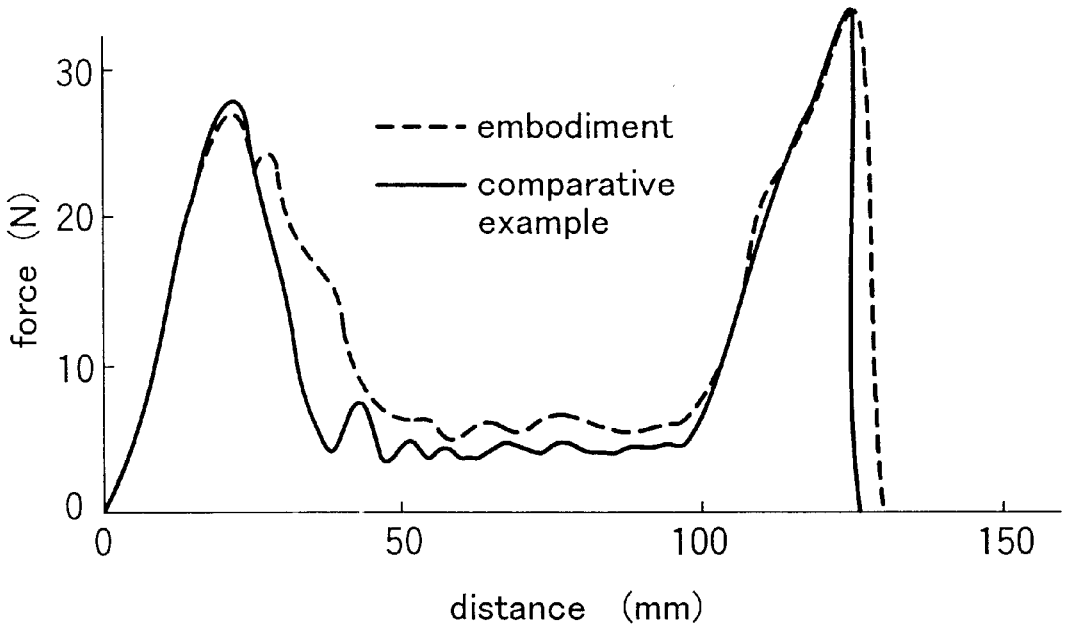
FIG. 19*a* is showing a test result for readiness of opening the container by tensile tester.
Figure 19B:
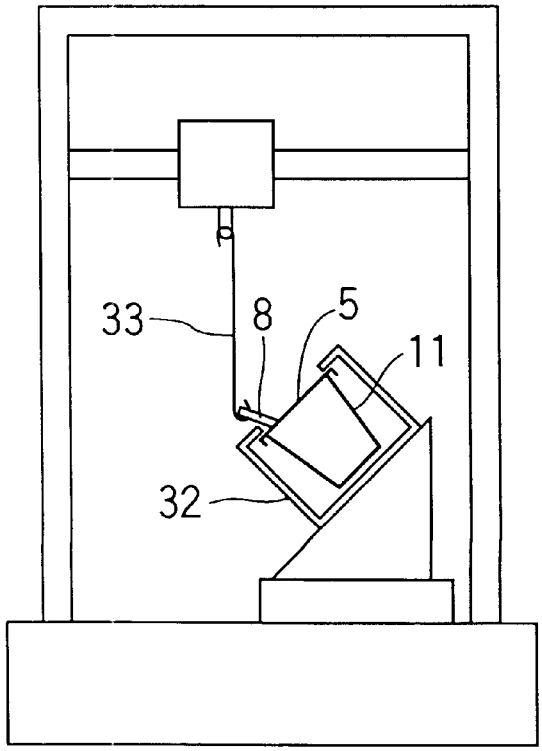
FIG. 19*b* is showing the tensile tester used in FIG. 19*a.*

The evaluation result of operation feeling is shown in Table 2 of FIG. 12*a* and FIG. 19*a* and the evaluation result of drop strength is also shown in Table 3 of FIG. 12*b* respectively.

In the evaluation of operation feeling, the operation feeling was evaluated in 5 levels of 2 (Good), 1, 0, −1 and −2 (Bad) by 10 panelists. The scores were averaged to make evaluation result.

As seen from Table 2 for the result of the operation feeling, the 10 embodiment and the comparative sample had almost the same result. In the opening operation of a container closure, the embodiment having the thin layer on the score line is slightly inferior to the comparative sample devoid of the thin layer. However, the result shows that the difference has no negative influence on the opening operation.

As seen from FIG. 19*a*, in the force required in the start stage of and completion stage the opening operation, both results of the embodiment and the comparative sample has substantially no difference. Though the embodiment requires more force during the intermediate stage of the opening operation, the operation feeling has no negative influence because the gas blocking substance can be easily broken due to the effect of shearing force in this stage. This is supported by the evaluation result of 10 panelists shown in Table 2 of FIG. 12*a*.

The conditions of the drop test shown in FIG. 12*b* are as follows.

1) The dropping direction was selected in the most severe condition causing break of a container closure due to a drop. On the condition that the connecting portion between the container closure and container body was dropped at an angle to make the connecting portion hit the ground, the first direction was that the front edge portion of the pulling tab of the container closure was faced downwardly. Second direction was that the front edge portion of the pulling tab was rotated by 90° from the position of the first direction so that the thin layer is faced downwardly to make this portion hit the ground first. The ground was concrete.

2) Number of sample was 10. Several heights for dropping were taken between 80 cm and 130 cm. In Table 3, denominator shows number of samples tested at each height and numerator shows numbers of container closure broken within the tested samples at each height. Every break took place at the score section of the container closure.

As seen in Table 3 of FIG. 12, on the container closure having the score line only composed of the multi-layered substrate, the competitive sample has almost same result as that of the embodiment in the first direction where front edge portion of the pulling tab hit the ground first. In the second direction where the front edge portion of the pulling tab was rotated by 90° from the position of the first direction, the drop strength of the competitive sample is about 90 cm as almost same as that in the first direction. However, on the embodiment having the thin layer, no break takes place even in 130 cm of height for dropping. Considering various dropping directions at store-front, it can evaluate that the drop strength of the embodiment according to the present invention is improved.

EXAMPLE 2

Figure 14:
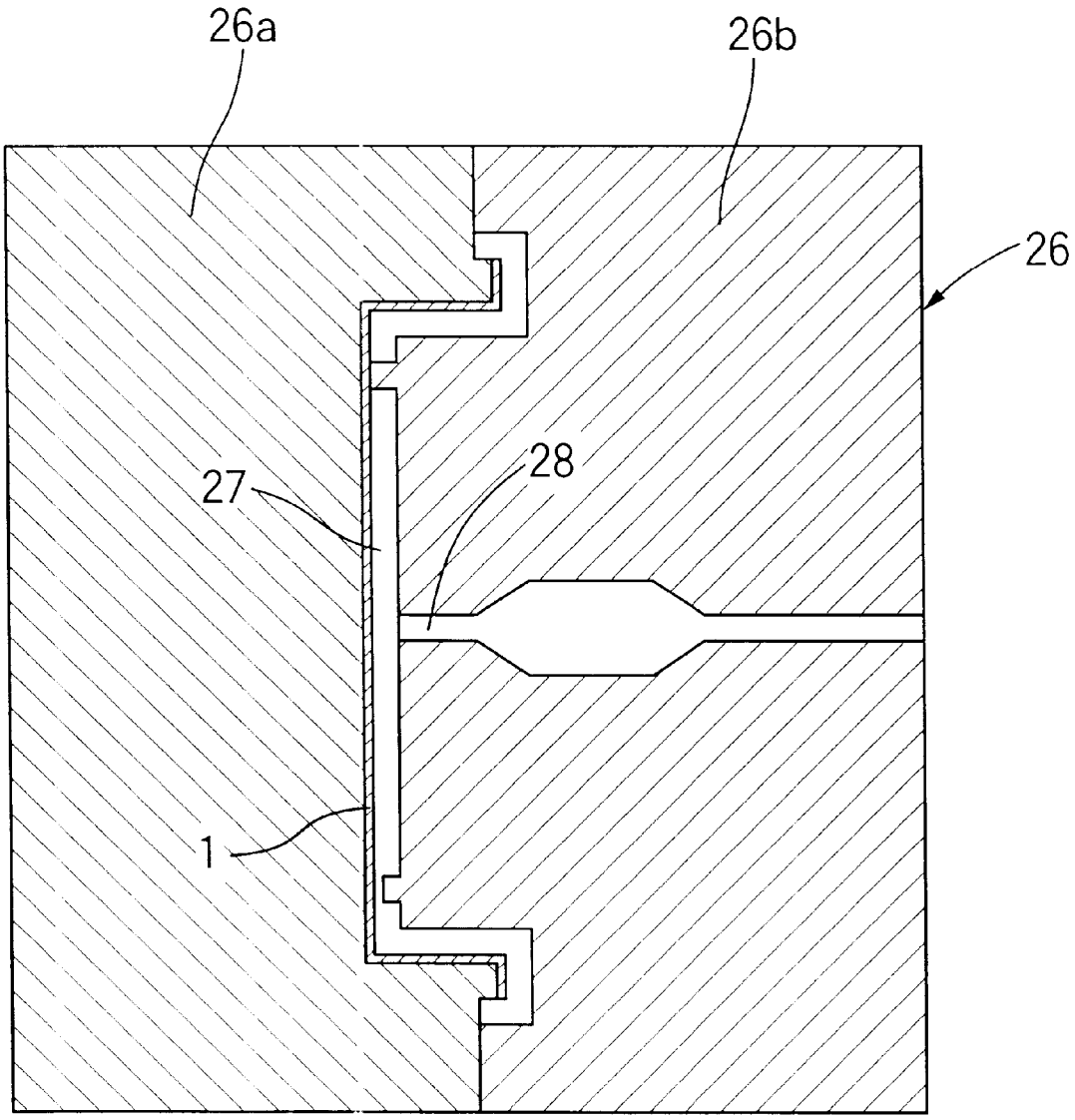
FIG. 14 is cross-sectional view showing a mold used for another embodiment of the present invention.

Another container closure was formed by using the mold shown in FIG. 14. The mold used for this embodiment was different from the mold shown in FIG. 7 in the point that the pulling tab was not formed with the panel section integrally. A mold 26 comprises a lower mold 26*a* and an upper mold 26*b*. A gate 28 for injecting molten plastic material is formed in the upper mold 26*b* at the position corresponding to around the center of a molted container closure. The upper mold includes an annular projection as same as the annular projection of the mold shown in FIG. 7.

Figure 15A:
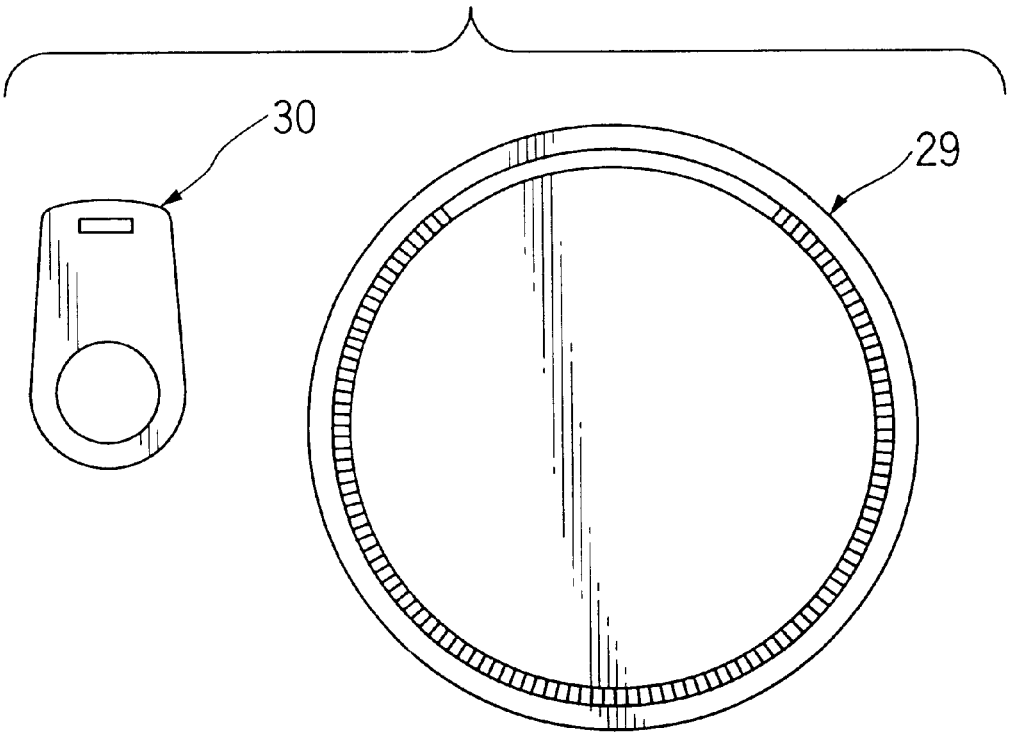
FIG. 15*a* is a top view showing a container closure formed by the mold of FIG. 14.
Figure 15B:
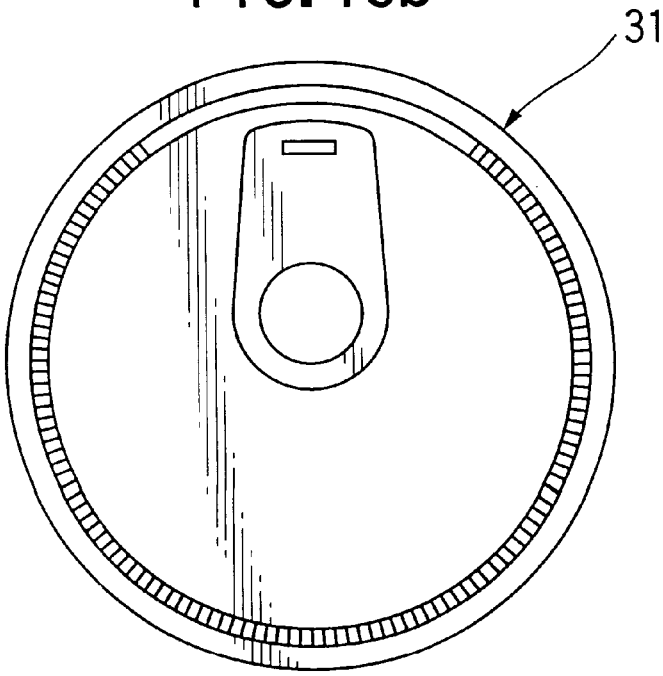
FIG. 15*b* is a top view showing a condition when a tab is attached to the container closure of FIG. 15*a;*

As shown in FIG. 14, a gas blocking substrate was positioned in a mold cavity of the mold 26 and an ethylene propylene block copolymer (Nippon Polyolefin PM970W, M.F.R.=30) was injected through the gates 27 to form container closure 29 shown in FIG. 15*a* by J-180E II-SP type injection molding machine produced by JSW. Preparing a tub or a pulling tab 30 made of the same plastic, a container closure having a opening mechanism shown in FIG. 15 was provided by securing the pulling tab to a container closure by using ultrasonic sealing process.

It will be noted from the above description, this invention can provide a container closure that can be formed by one gate. Thus, interference of each manifold can be avoided so that higher number of molds can be attached in comparison with the case using two or more gates. As the result, lower plant investment can be achieved. Further, resultant container closure can improve its drop strength with maintaining standard performance in the opening operation.

The present invention may be embodied in other specific ways without departing from the spirit or essential characteristics thereof. The preferred embodiments described herein are therefore to be considered in all respects as illustrative and not restrictive, the scope of the invention being indicated by the appended claims rather than by the foregoing description. And all variations and modifications which come within equivalent of the claims are intended to be embraced therein.

What is claimed is:

1. A container closure for closing an opening of a container body, comprising:

a substrate having adequate property for retaining an object which is enclosed in a container body, one side of said substrate being attachable to a container body, and wherein said substrate includes a heat-fusible plastic layer;

a peripheral section covering a periphery area of said substrate on the opposite side of the side of said substrate being attachable to a container body;

a panel section covering an area of said substrate which is surrounded by said peripheral section and on the side having said peripheral section; and a score section formed between said peripheral section and said panel section to provide a weakened region, wherein said peripheral section and said panel section are formed of a heat-fusible plastic material which is the same heat-fusible plastic material on said substrate, wherein a portion of said score section includes a thin layer which has a thickness which is less than a thickness of said peripheral section and said panel section, and wherein said thin layer connects said peripheral section and said panel section, and wherein said thin layer is formed of a heat-fusible material which is the same heat-fusible plastic material as said peripheral section and said panel section, wherein a pulling tab is integrally molded with said panel section, for separating said panel section from said peripheral section along said score section.

2. A container closure in accordance with claim 1, wherein said panel section further includes a pulling tab for separating said panel section from said peripheral section along said score line by pulling said pulling tab off.

3. A container closure in accordance with claim 2, wherein said thin layer is not provided on a puncture portion of said score section corresponding to an area where a front edge of said pulling tub punctures.

4. A container closure in accordance with claim 3, wherein said thin layer is not provided on an area of said score section opposed to said puncture portion in a radial direction.

5. A container closure in accordance with claim 3, wherein said thin layer is provided on all areas of said score section except for said puncture portion.

6. A container closure in accordance with claim 1, wherein said substrate comprises a base layer having gas blocking property and the heat-fusible plastic layer laminated on at least one side of said base layer.

7. A container closure in accordance with claim 1, wherein said panel section further includes a bank-like edge provided in at least a part of the periphery portion contacted to said score section.

8. A container closure in accordance with claim 2, wherein said substrate comprises a base layer having gas blocking property and the heat-fusible plastic layer laminated on at least one side of said base layer.

9. A container closure in accordance with claim 3, wherein said substrate comprises a base layer having gas blocking property and the heat-fusible plastic layer laminated on at least one side of said base layer.

10. A container closure in accordance with claim 4, wherein said substrate comprises a base layer having gas blocking property and the heat-fusible plastic layer laminated on at least one side of said base layer.

11. A container closure in accordance with claim 5, wherein said substrate comprises a base layer having gas blocking property and the heat-side fusible plastic layer laminated on at least one side of said base layer.

12. A container closure in accordance with claim 2, wherein said panel section further includes a bank-like edge provided in at least a part of the periphery portion contacted to said score section.

13. A container closure in accordance with claim 3, wherein said panel section further includes a bank-like edge provided in at least a part of the periphery portion contacted to said score section.

14. A container closure in accordance with claim 4, wherein said panel section further includes the bank-like edge provided in at least a part of the periphery portion contacted to said score section.

15. A container closure in accordance with claim 5, wherein said panel section further includes a bank-like edge provided in at least a part of the periphery portion contacted to said score section.

16. A container closure in accordance with claim 6, wherein said panel section further includes a bank-like edge provided in at least a part of the periphery portion contacted to said score section.

17. A container closure in accordance with claim 1, wherein said thin layer is formed directly on said substrate.

* * * * *